US006193531B1

(12) United States Patent
Ito et al.

(10) Patent No.: US 6,193,531 B1
(45) Date of Patent: Feb. 27, 2001

(54) LEVER TYPE CONNECTOR

(75) Inventors: Osamu Ito; Hiroki Osawa, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/299,442

(22) Filed: Apr. 26, 1999

(30) Foreign Application Priority Data

May 1, 1998 (JP) ..... 10-122185

(51) Int. Cl.[7] ..... H01R 13/62
(52) U.S. Cl. ..... 439/157; 439/372; 439/140
(58) Field of Search ..... 439/157, 160, 439/310, 372, 140

(56) References Cited

U.S. PATENT DOCUMENTS

| | | | | |
|---|---|---|---|---|
| 5,269,696 | | 12/1993 | Okada et al. | 439/157 |
| 5,395,258 | * | 3/1995 | Okumura et al. | 439/372 |
| 5,460,534 | * | 10/1995 | Taniuchi et al. | 438/372 |
| 5,681,175 | * | 10/1997 | Busse et al. | 439/372 |

FOREIGN PATENT DOCUMENTS

| | | | | |
|---|---|---|---|---|
| 6251826 | * | 9/1994 | (JP) | 439/372 |

* cited by examiner

*Primary Examiner*—Renee Luebke
*Assistant Examiner*—Briggitte Hammond
(74) *Attorney, Agent, or Firm*—Anthony J. Casella; Gerald E. Hespos; Michael J. Porco

(57) ABSTRACT

A lever type connector is provided with a lever that has a rotatable or pivotable range wider than its rotatable or pivotable range during the connection of male and female housings without changing a moving stroke of a moving plate. The lever 20 is enabled to rotate from a connection start position to a connection end position located opposite from a standby position, and each cam groove 24 is formed with a play area 24C for preventing the lever 20 from being interfered with by cam pins 32 of a moving plate 30 when the lever 20 is rotated or pivoted toward the standby position. Since the cam grooves 24 of the lever 20 and the cam pins 32 of the moving plate 30 do not interfere with each other while the lever 20 is rotated or pivoted from the connection start position to the standby position, the moving plate 30 will not move together with the lever 20.

11 Claims, 10 Drawing Sheets

LEVER TYPE CONNECTOR

BACKGROUND OF THE INVENTION

1. Field of the Invention

The present invention relates to a lever type connector.

2. Description of the Related Art

Some known lever type connectors are provided with a male housing having a receptacle and carrying a lever, a female housing to be fittable into the receptacle, and a moving plate movable in the receptacle. The female housing and the moving plate are provided with cam pins that engage with cam grooves of the lever. The lever is rotated from a connection start position to a connection end position to draw the female housing and the moving plate into the receptacle by the action of cams, thereby connecting the male and female connectors.

The lever and the moving plate of the prior art lever type connector are assembled with the male housing at a factory. This housing is shipped to a site of assembling where it is assembled with a bracket and then connected with the female housing. In this case, a rotatable range of the lever during the connection is set such that the lever will not interfere with the bracket. However, a limit in the rotatable range of the lever may cause the lever to project from the outer surface of the male housing in an isolated manner before being assembled with the bracket. If the male housing is shipped in such a state, the lever may be broken by interference with other members.

To avoid this problem, the rotatable range of the lever may be made wider than its rotatable range during the connection of the housings so as to locate the lever in a position where other members are unlikely to interfere with the lever when the male housing is shipped. However, the cam pins of the moving plate are engaged with the cam grooves of the lever. Thus widening of the rotatable range of the lever means a larger moving stroke of the moving plate in the receptacle. Consequently, there is a limit in widening the rotatable range of the lever. A forcible attempt to widen the rotatable range results in the enlargement of the receptacle.

In view of the above problems, an object of the present invention is to make the rotatable or pivotable range of a lever wider than its rotatable or pivotable range during the connection of male and female housings without changing a moving stroke of a moving plate.

SUMMARY OF THE INVENTION

According to the invention, there is provided a lever type connector, comprising a male housing having a receptacle. A female housing is at least partially fittable or insertable into the receptacle and has at least one cam pin. A moving plate is movable along a fitting direction in the receptacle and also has at least one cam pin. A lever having one or more cam grooves is engageable with the cam pins and is rotatably or pivotably supported on the male housing. The female housing and the moving plate are drawn into the receptacle in the fitting direction by rotating or pivoting the lever in a connection direction from the connection start position to the connection end position with the cam pins and the cam grooves engaged with each other. The lever is permitted to rotate or pivot in a direction opposite to the connection direction from the connection start position to a standby position. The standby position preferably is opposite from the connection end position. The cam grooves each are provided with a play area which is substantially not in engagement with the corresponding cam pin of the moving plate during the rotation or pivotal movement of the lever in a direction opposite to the connection direction from the connection start position toward the standby position.

Since the cam grooves of the lever and the cam pins of the moving plates are not engaged with each other during the rotation of the lever from the connection start position to the standby position, the moving plate will not move together with the lever.

According to a preferred embodiment of the invention, the male housing is formed with a receiving portion for receiving the lever when the lever is rotated to the standby position. With the lever rotated to the standby position and received by the receiving portion, a contact force given to the lever from another member is received by the receiving portion. Accordingly, no excessive stress acts on the lever.

Preferably, the receiving portion projects from the male housing such that the lever cannot be externally reached in a direction opposite to the fitting direction. Accordingly, the lever cannot be inadvertently displaced (e.g. during shipping) by an external object hitting the connector from a side opposed to the mating side Further preferably, the cam pins of the female housing and those of the moving plate are unitable and each pair of the united cam pins are engaged with the corresponding cam groove. Since each pair of the cam pins of the moving plate and the female connector housing are engaged with the corresponding cam grooves while being united, one cam groove is sufficient for one pair of the cam pins of the moving plate and the female connector. As a result, the lever can be made smaller.

Most preferably, the cam groove comprises a receiving inlet for receiving the corresponding cam pin upon mating the female housing with the male housing.

According to a further preferred embodiment, the male housing and/or the female housing are provided with locking means for temporarily locking the lever in the connection start position, the connection end position and/or the standby position.

The cam pins of the moving plate may be held by the inner surfaces of the play areas along the fitting direction when the lever is positioned in the standby position. Thus a loose movement of the moving plate with respect to the receptacle is prevented.

The male housing may be fittable into or onto a bracket preferably with the lever being positioned in a substantially upright position.

Still further preferably, the lever may come into contact with the bracket in a direction opposite to the connection direction when the lever is positioned in the connection start position.

Most preferably, the moving plate comprises a guide wall portion for guiding the movement of the moving plate inside the receptacle of the male housing.

These and other objects, features and advantages of the present invention will become more apparent upon a reading of the following detailed description and accompanying drawings.

DETAILED DESCRIPTION OF THE PREFERRED EMBODIMENT

Figure 1:
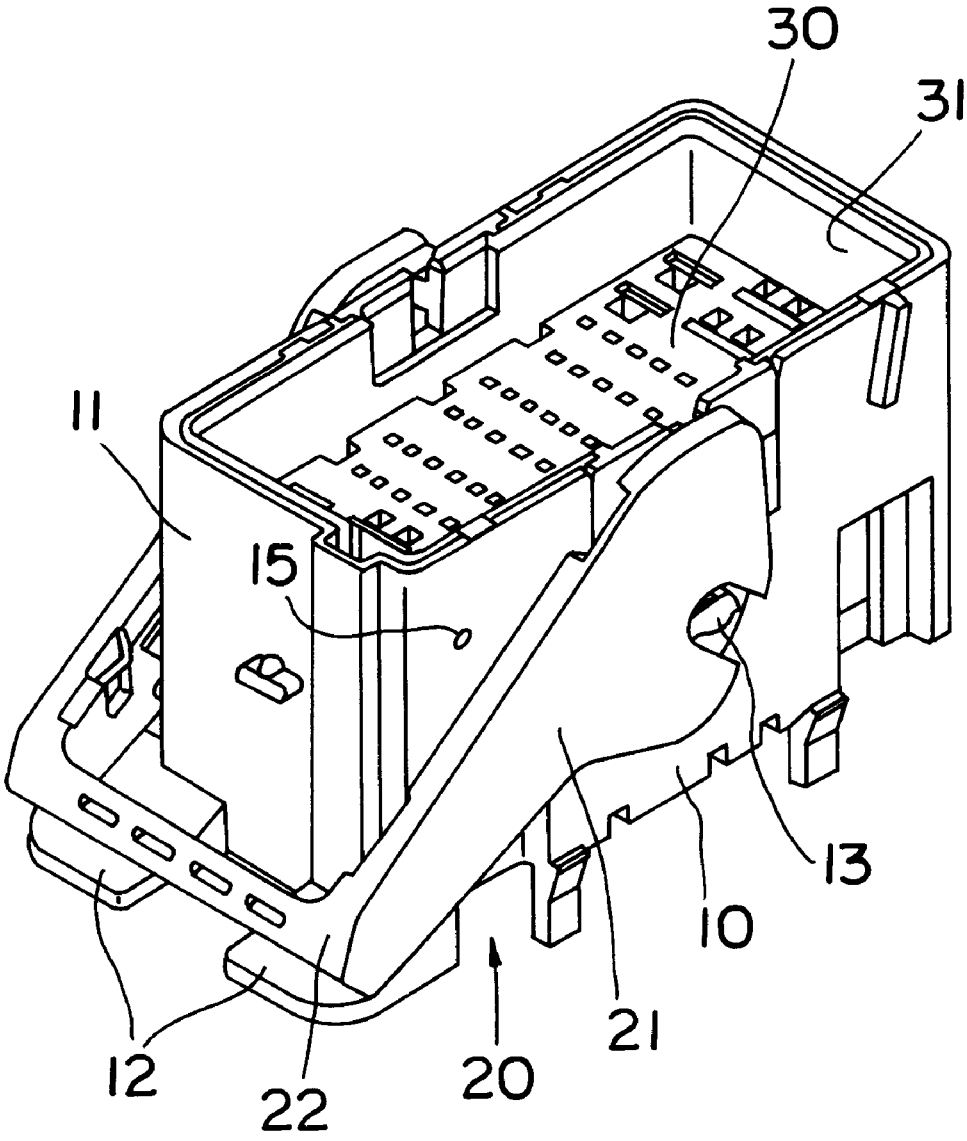
FIG. 1 is a perspective view showing a state of one embodiment where a lever is in a standby position.

A lever type connector according to one embodiment of the invention is comprised of a male housing 10, a lever 20, a moving plate 30 and a female housing 40, as shown in FIGS. 1–11. The male housing 10 has a receptacle 11 which is open towards a mating side or upward and has a substantially rectangular cross section. A plurality of unillustrated male terminal fittings project upwardly inside the receptacle 11. The male housing 10 is connected or is connectable with the female housing 40, and is assembled with a bracket 50 by being fitted or arranged into or onto the bracket 50 from below. In its assembled state, the male housing 10 has its movement in an assembling direction (upward direction) restricted by receiving portions 12 projecting from the outer surface thereof and is locked or lockable by elastic locking pieces 51 provided preferably on the inner side of the bracket 50, as shown in FIGS. 6–9.

The moving plate 30 is accommodated or accommodatable in the receptacle 11, and is movable upward and downward with the respective male terminal fittings penetrated or displaceable therethrough. The moving plate 30 has a substantially tubular guide wall portion 31 on its periphery. By arranging or mating this guide wall portion 31 substantially along or on (portions of) the inner surface of the receptacle 11, the moving plate 30 can be moved while being held or oriented or positioned in a specified orientation or position. A pair of cam pins 32 project from the outer surface of each of the lateral or left and right walls of the guide wall portion 31 of the moving plate 30. The pair of cam pins 32 preferably are formed to have a comb-like shape or one or more notches or recesses by cutting a center portion of a cylinder as enlargedly shown in FIGS. 10 and 11, and a cam pin 42 of the female housing 40 is fitted or fittable into a clearance 33 between the cam pins 32.

The female housing 40 is shaped and dimensioned to be fittable into the receptacle 11, and a wire cover 41 is mounted or mountable on the upper surface thereof. The cam pins 42 preferably project from the lateral or left and right side surfaces of the female housing 40, or the surface thereof opposed to the mating surface for mating the female housing 40 with the male housing 10. The cam pins 42 preferably have a substantially oval or rounded cross section, and are fitted or fittable between the comb-shaped cam pins 32 of the moving plate 30, preferably from above, to be united or mated or to interact with the cam pins 32. An assembly of the united cam pins 32, 42 has a substantially cylindrical shape as a whole (see FIG. 11). The cam pins 42, in their united state, are engaged in cam grooves 24 of the lever 20 to be described later.

The lever 20 has a pair of plate-shaped arms 21 connected by an operation portion 22. The end portion of each arm 21 has a bearing hole 23 and a cam groove or recess 24 substantially surrounding the bearing hole 23. The lever 20 is rotatably or pivotably supported by engaging the bearing holes 23 with support shafts 13 of the male housing 10. Specifically, the lever 20 is rotatable or pivotable between a connection start position (shown in FIGS. 2, 3, 7, 8) and a connection end position (shown in FIGS. 4 and 9). The lever 20 also is rotatable or pivotable from the connection start position to a standby position (shown in FIGS. 1 and 5) located substantially opposite from the connection end position.

A rotational or pivotal range of the lever 20 between the connection start position (FIGS. 2 and 3) and the connection end position (FIGS. 4 and 9) is set such that the lever 20 does not interfere with the bracket 50 while the male housing 10 is assembled with the bracket 50. In other words, in the connection start position, the operation portion 22 of the lever 20 is preferably substantially in contact with the upper end surface of a side wall portion 52 of the bracket 50 on the left side of FIGS. 7 and 8. When the lever 20 is rotated or pivoted toward the connection end position, the operation portion 22 is displaced to a position above the bracket 50 and the male housing 10 in a clockwise direction in FIGS. 9.

Figure 5:
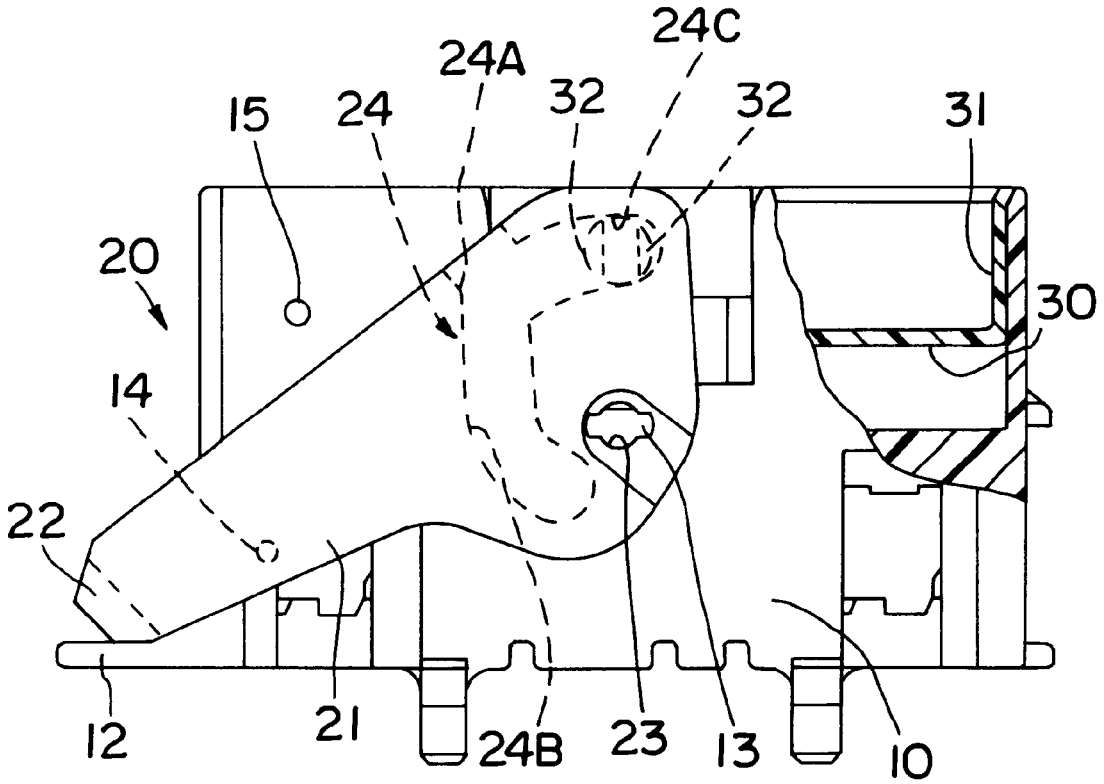
FIG. 5 is a side view partly in section showing a state where the lever is in the standby position.
Figure 6:
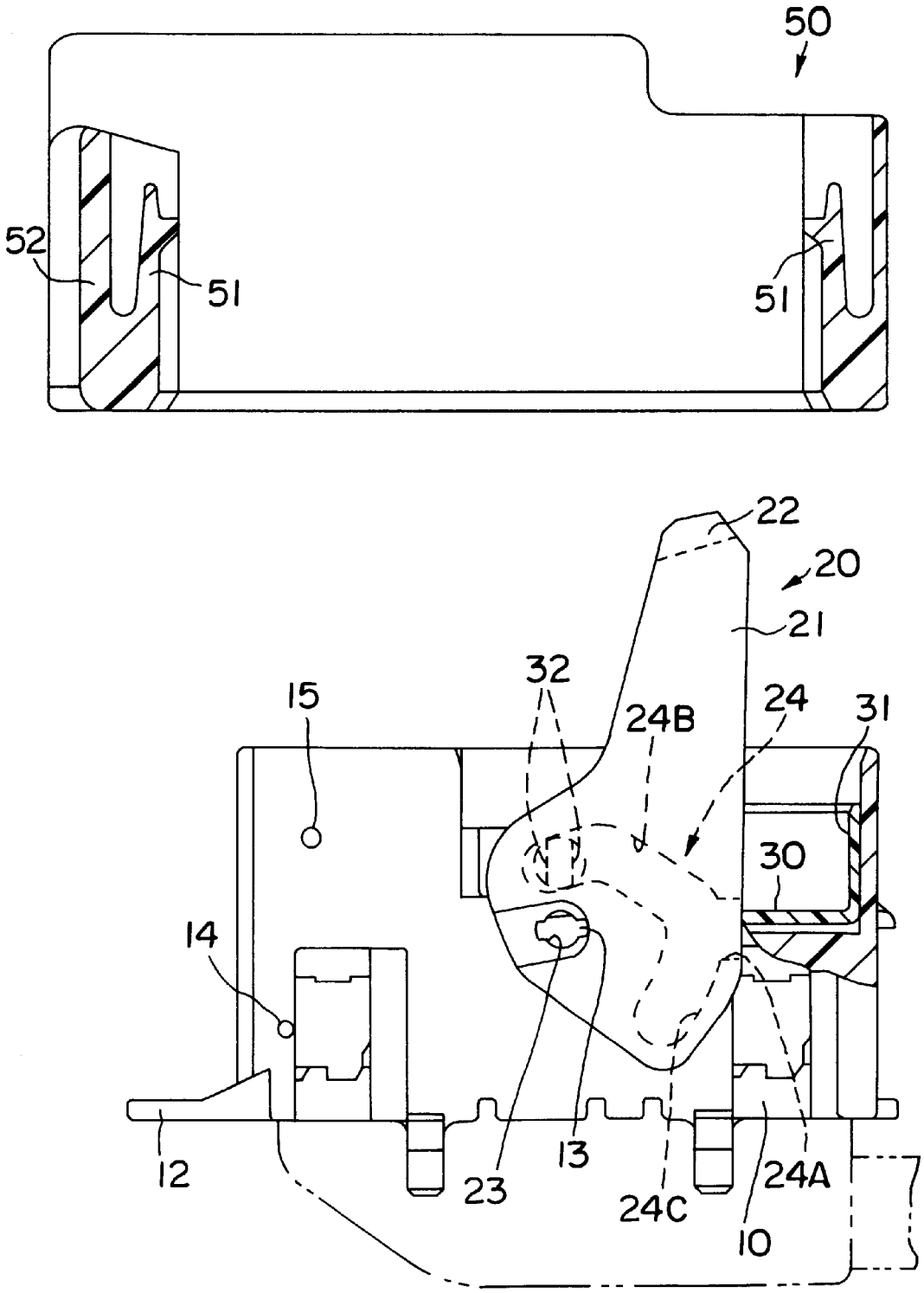
FIG. 6 is a side view partly in section showing a state where the lever is in such a position that the male housing can be assembled with a bracket.
Figure 7:
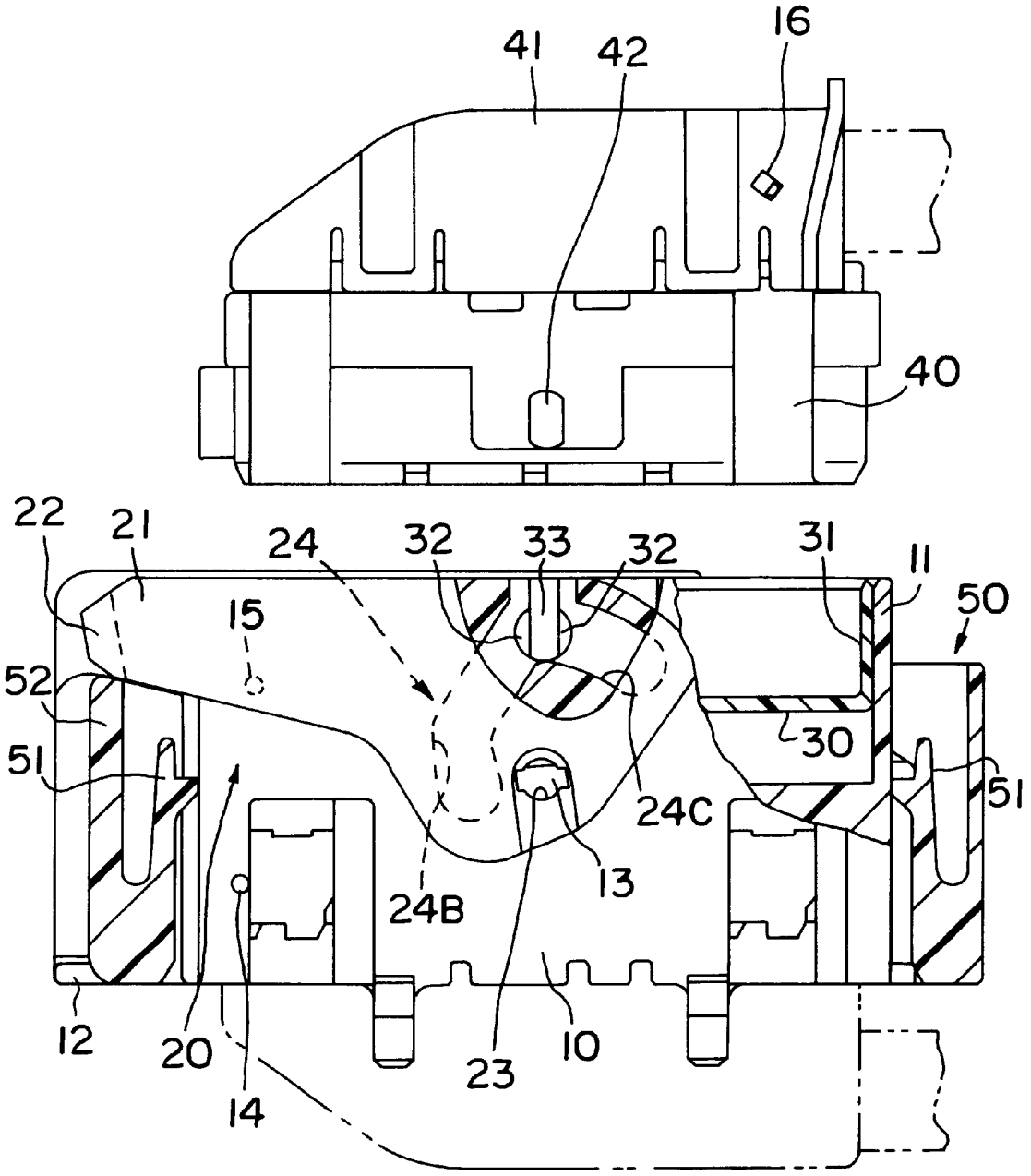
FIG. 7 is a side view partly in section showing a state where the lever is in the connection start position.
Figure 8:
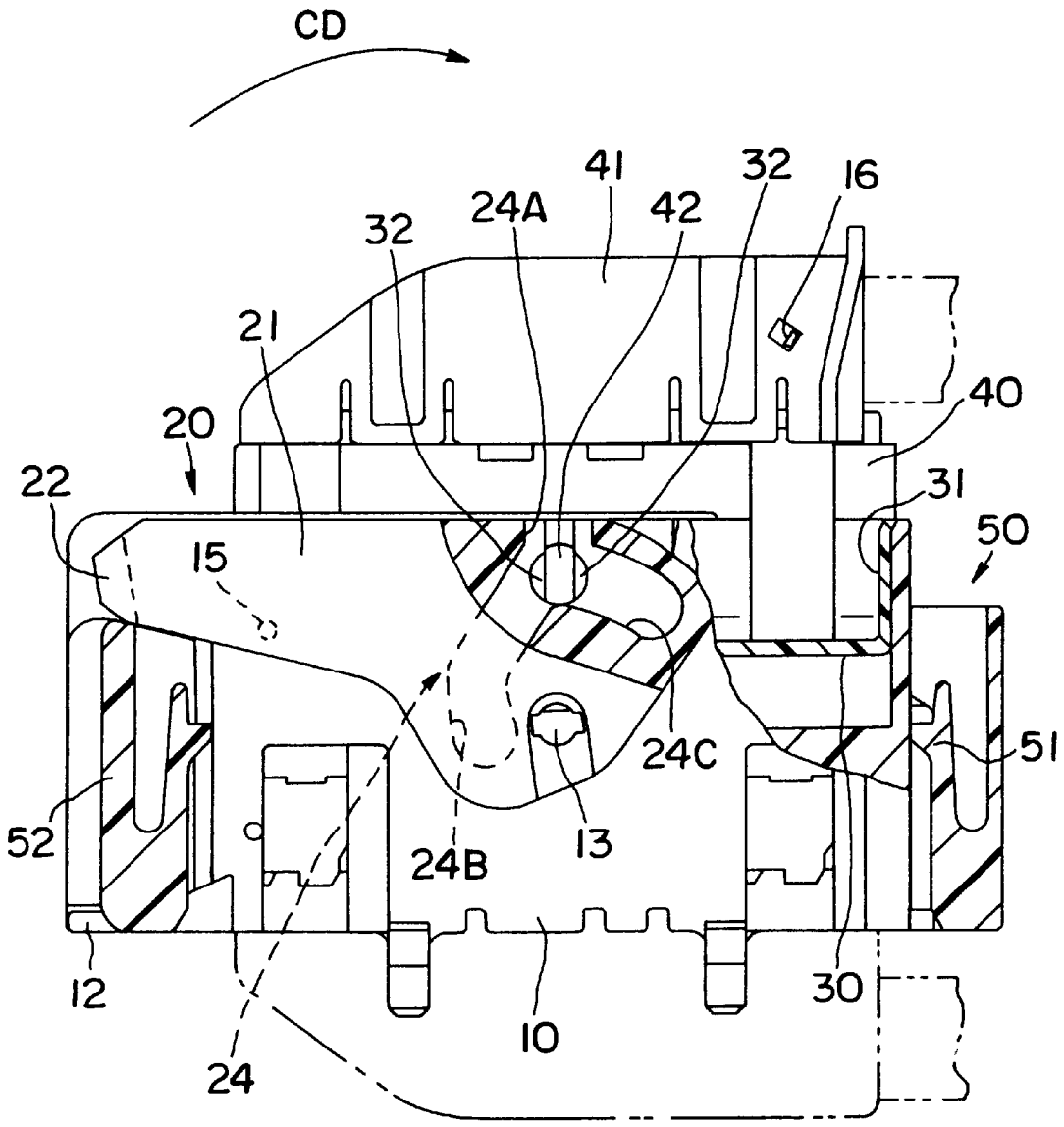
FIG. 8 is a side view partly in section showing a state where the connection of the male and female housings is started.
Figure 9:
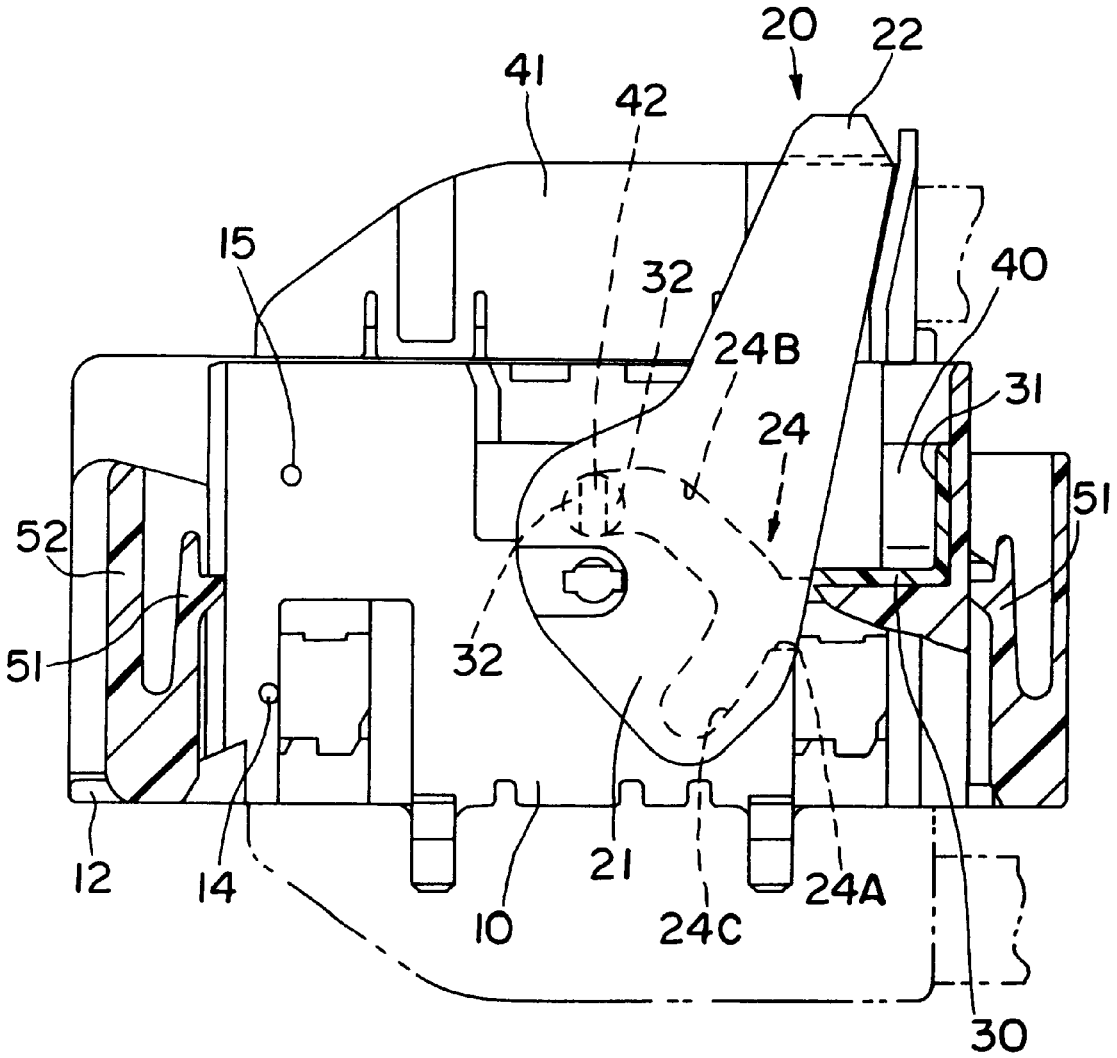
FIG. 9 is a side view partly in section showing a state where the connection of the male and female housings is completed.
Figure 10:
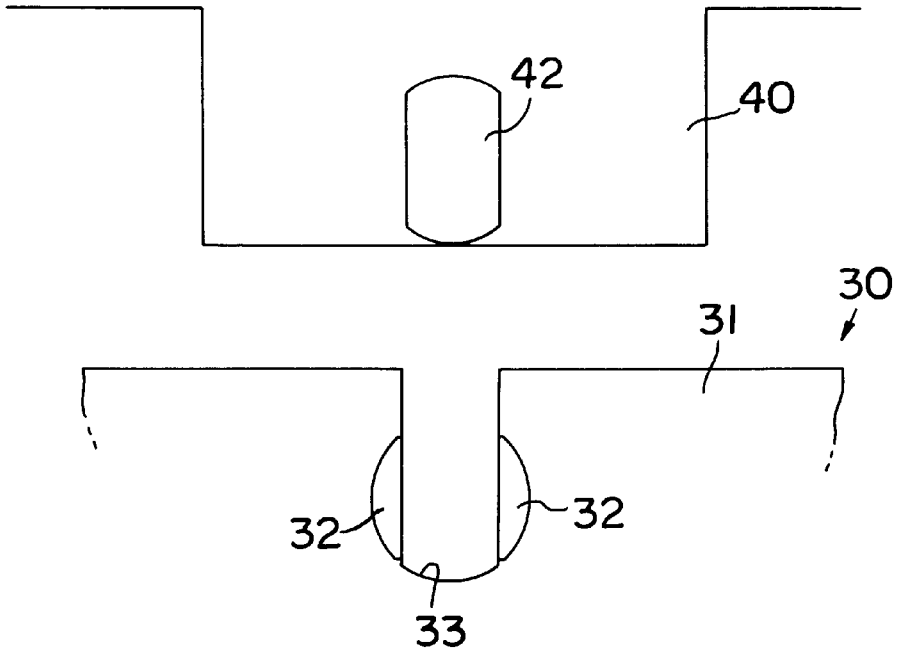
FIG. 10 is an enlarged partial view showing a state where a cam pin of the female housing and a cam pin of a moving plate are separated.
Figure 11:
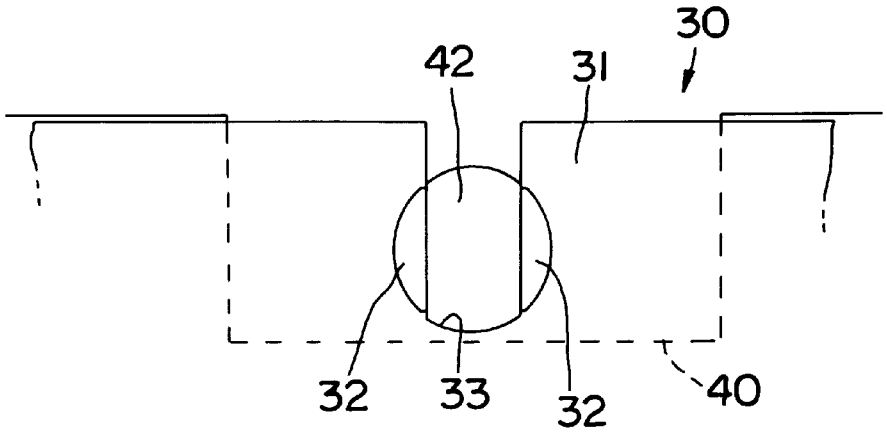
FIG. 11 is an enlarged partial view showing a state where the cam pin of the female housing and the cam pin of the moving plate are united.

Further, when the lever 20 is rotated or pivoted to the standby position (FIGS. 1 and 5), the male housing 10 must be detached from the bracket 50. In other words, the operation portion 22 is displaced substantially downward in an area where there was or is to be arranged the left side wall 52 of the bracket 50 when the lever 20 is rotated or pivoted to the standby position. When the operation portion 22 substantially reaches its standby position, it contacts the receiving portion 12 and further rotation is prevented (FIGS. 1 and 5).

Each cam groove 24 is formed with a receiving inlet 24A for permitting the cam pins 32, 42 to enter the cam groove 24 with the lever 20 in its connection start position. A part of the cam groove 24 with which the cam pins 32, 42 are engaged or engageable while the lever 20 is rotated or pivoted from the connection start position to the connection end position is a substantially spiral or arcuate engaging area 24B for connection which gradually approaches the bearing hole 23 (support shaft 13). When the lever 20 is rotated or pivoted from the connection start position (FIGS. 7 and 8) to the connection end position (FIG. 9), the female housing 40 and the moving plate 30 are drawn or pulled or forced at least partially into the receptacle 11 by the engagement of the engaging areas 24B and the cam pins 32, 42. When the lever 20 reaches the connection end position (FIGS. 4 and 9), the housings 10, 40 are connected properly.

On the other hand, a part of the cam groove 24 extending from the receiving inlet 24A in a direction opposite from the engaging area 24B is a play area 24C (or loose movement area or clearance area) in the shape of a right arc about the bearing hole 23. The cam pins 32 of the moving plate 30 are relatively displaced in circumferential direction in the play areas 24C while the lever 20 is rotated or pivoted from the connection start position (FIGS. 7 and 8) to the standby position (FIG. 5). Since the play areas 24C are substantially in the shape of an arc substantially concentric with the center of rotation of the lever 20, the moving plate 30 and/or the female housing 40 will not move together with the lever 20.

Next, the assembling, mounting and/or action of this embodiment is described.

The male housing 10 is assembled with the lever 20 and the moving plate 30 as follows, preferably at a factory from which it is shipped. First, the lever 20 is mounted. With the lever 20 in its connection start position, the moving plate 30 is fitted into the receptacle 11, and the cam pins 32 are introduced into the cam grooves 24 through the receiving inlets 24A. Thereafter, the lever 20 is rotated or pivoted from the connection start position to the standby position (see FIGS. 1 and 5). The assembling is completed in this manner and the male housing 10 preferably is shipped to a site of assembling. It should be noted that the lever 20 is held temporarily in the standby position by one or more locking projections 14 formed preferably on the outer surface of the male housing 10 and preferably interacting with the plate-shaped arm(s) 21 of the lever 20.

While the lever 20 is rotated or pivoted to the standby position, the moving plate 30 is not displaced from its initial position since the cam pins 32 of the moving plate 30 are not engaged with the play areas 24C of the cam grooves 24. Further, since the cam pins 32 of the moving plate 30 are held from substantially opposing sides along the fitting direction FD or the vertical direction by the inner surface of the play areas 24C, a loose movement of the moving plate 30 with respect to the receptacle 11 also is prevented.

With the lever 20 located in the standby position, the operation portion 22 of the lever 20 projects leftward from the left outer surface of the male housing 10 in the FIGS. 1 and 5 and is substantially in contact with the upper surface of the receiving portion 12. Accordingly, even if another member pushes the operation portion 22 from above during shipment, this pushing force is received by the receiving portion 12. Thus, no excessive stress acts on the lever 20. Conversely, even if an upward pushing force from another member acts on the receiving portion 12 from below, this pushing force is received by the receiving portion 12 without directly acting on the operation portion 22. Thus, in this case, a stress does not act on the lever 20, either.

Figure 2:
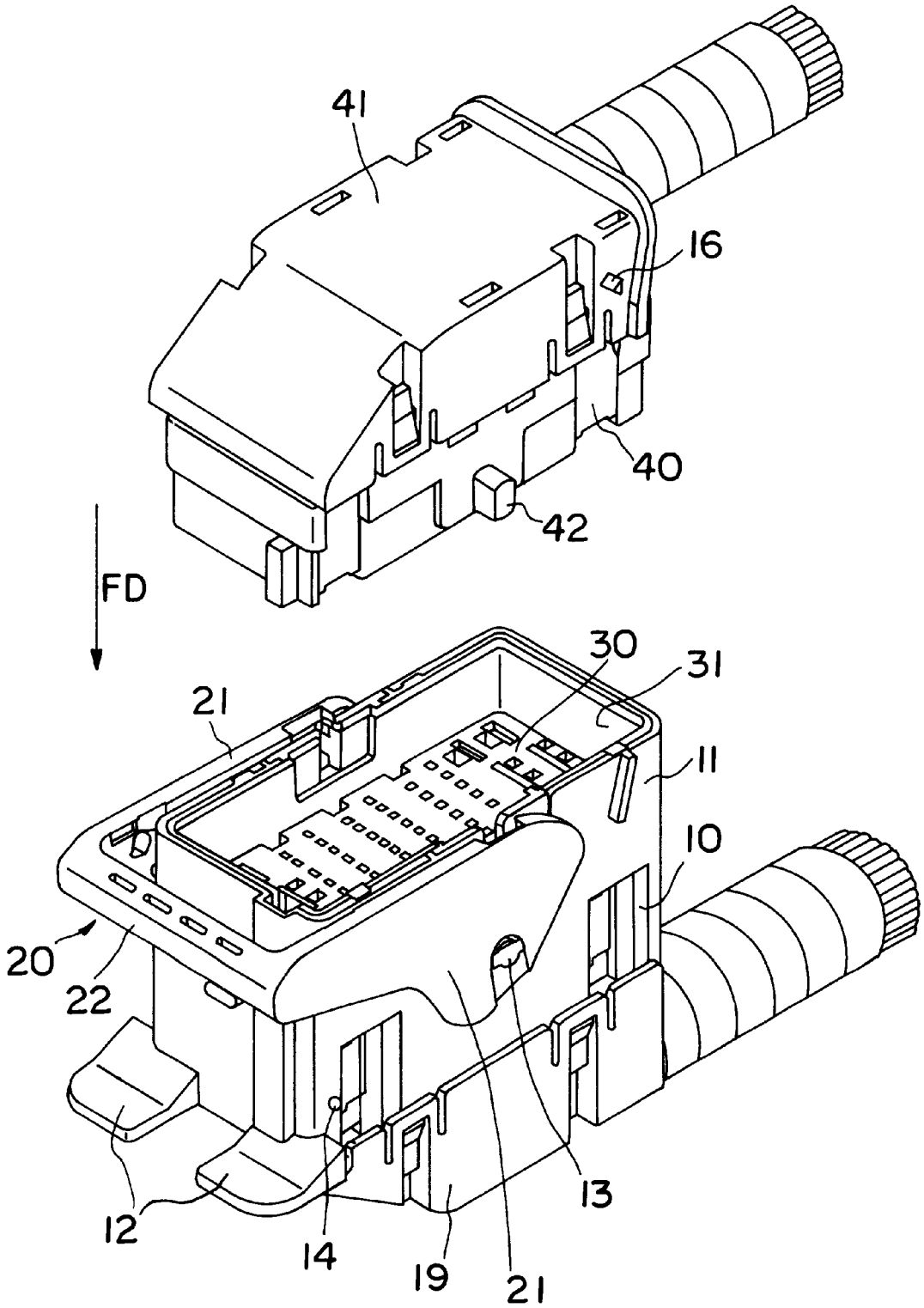
FIG. 2 is a perspective view showing a state where the lever is in a connection start position.
Figure 3:
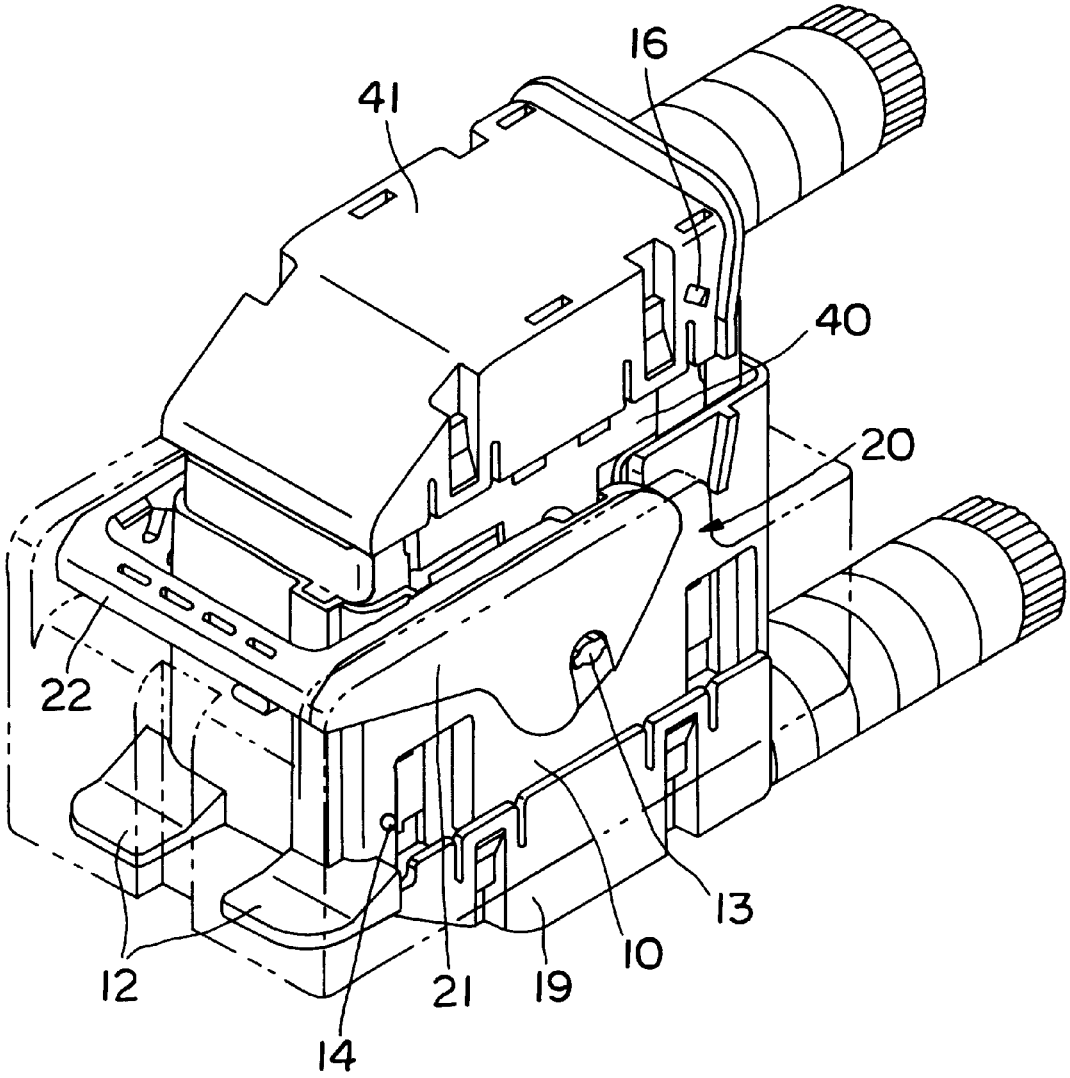
FIG. 3 is a perspective view showing a state where the connection of male and female housings is started.
Figure 4:
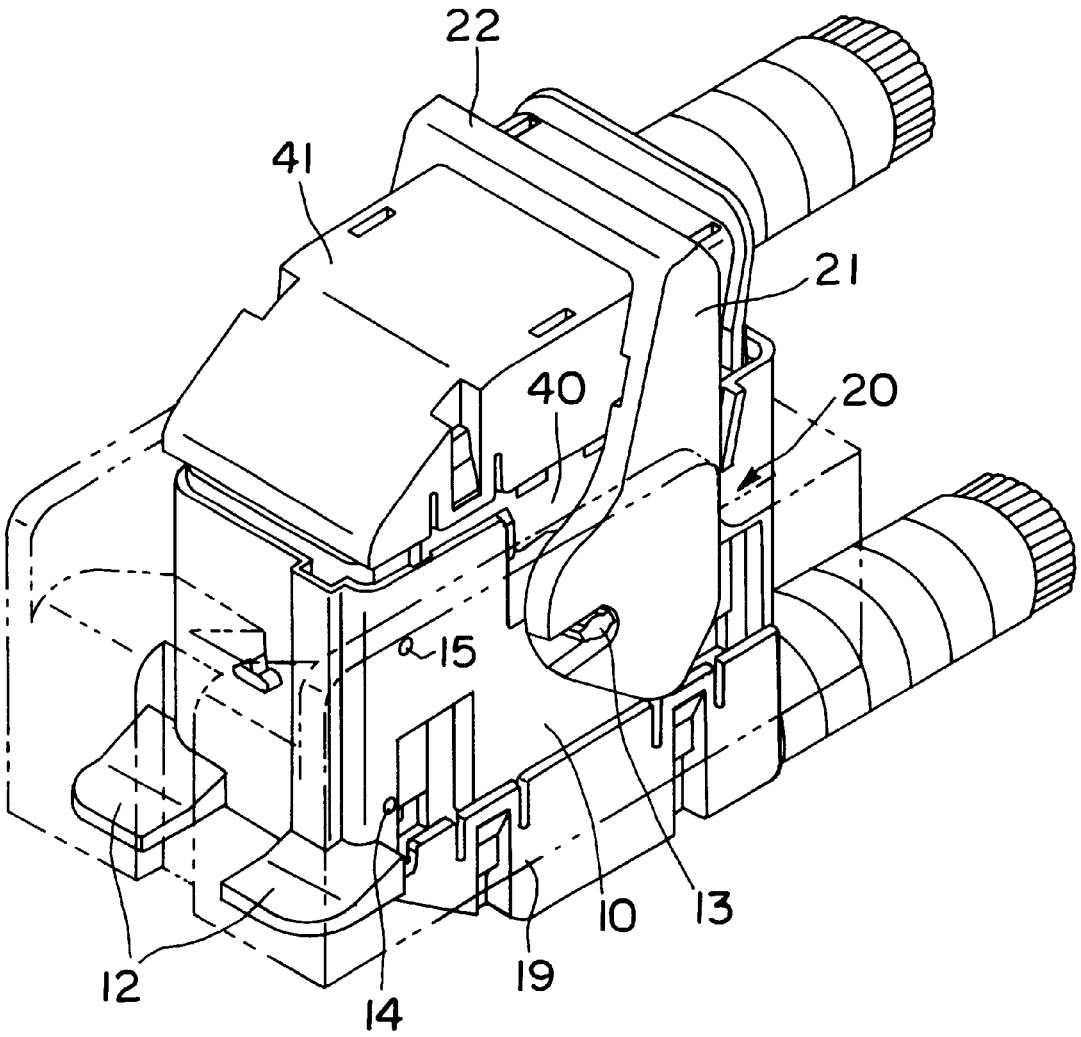
FIG. 4 is a perspective view showing a state where the connection of the male and female housings is completed.

When the lever 20 is in its connection start position, the operation portion 22 thereof projects from the left side surface of the male housing 10 in an isolated manner (see FIGS. 2 and 3). In other words, the operation portion 22 is positioned at a distance from the male housing 10. Accordingly, if the male housing 10 is shipped in this state, other members may interfere with the operation portion 22 e.g. in vertical direction, thereby displacing the lever 20 from the connection start position or creating an excessive stress unless the lever 20 is displaced. Contrary to this, since the male housing 10 is shipped with the lever 20 in the standby position in this embodiment, there is no likelihood that the lever 20 is displaced or an excessive stress acts on the lever 20.

The male housing 10, which preferably has been transported to the assembling site in this state, is assembled with the bracket 50 and connected with the female housing 40. In particular, the lever 20 rotated or pivoted in a connection direction CD (FIG. 8) from the standby position toward the connection end position until the arms 21 are brought substantially to upright positions, after having passed the connection start position (see FIG. 6). In this substantially upright position the lever 20 does not interfere with the bracket 50. Subsequently, the male housing 10 in this state is fitted into or onto the bracket 50 from below and then the lever 20 is returned to the connection start position (see FIGS. 2 and 7). Then, the lever 20 preferably is held temporarily in the connection start position by locking projections 15 formed on the male housing 10. It should be noted that a wire cover 19 shown in FIGS. 2 to 4 preferably is mounted or mountable on the male housing 10 before the male housing 10 is assembled with the bracket 10.

Subsequently, in this state, the female housing 40 which preferably has the wire cover 41 mounted thereon is fitted into the receptacle 11 from a mating or fitting direction FD (FIG. 2), e.g. from above. Then, the cam pins 42 of the female housing 40 enter the cam grooves 24 through the receiving inlets 24A, which are to be united or combined with the cam pins 32 of the moving plate 30 (see FIGS. 3 and 8). If the lever 20 is rotated or pivoted toward the connection end position in this state, the female housing 40 and the moving plate 30 are drawn or pulled or forced or urged together into the back of the receptacle 11 by the engagement of the cam pins 32, 42 and the engaging areas 24B of the cam grooves 24. When the lever 20 reaches the connection end position, the housings 10, 40 are connected properly (see FIGS. 4 and 9). In this connected state, the lever 20 is locked in the connection end position by being engaged with projections 16 formed on the wire cover 41.

As described above, the cam grooves 24 of the lever 20 have the play areas 24C which are not engageable with the cam pins 32 of the moving plate 30. Accordingly, the moving plate 30 does not move together with the lever 20 while the lever 20 is rotated or pivoted from the connection start position to the standby position.

Further, the receptacle 11 need not be enlarged in a direction of connection since the moving plate 30 will not be disengaged from the receptacle 11 even if the rotatable or pivotable range of the lever 20 is enlarged.

Since the cam pins 42 of the female housing 40 and the cam pins 32 of the moving plate 30 are engaged with the cam grooves 24 while being so united as to have a cylindrical shape, one cam groove 24 per arm 21 is sufficient and, as a result, the connector can be made smaller. If required even only one cam pin 42 of the female housing 40 and one cam pin 32 of the moving plain 30 may be arranged on the same side and engaged with one cam groove 24.

Upon disconnecting the male housing 10 and the female housing 40 by rotating the lever 20 in a direction opposite to the connection direction CD, the moving plate 30 sustains the disconnection by being oriented by the guide wall portion 31 and substantially prevents the housings from being angled or jammed. Moreover the moving plate 30 preferably prevents the male terminals from being excessively bent during the disconnection.

The present invention is not limited to the described and illustrated embodiment, but the following embodiments also are embraced by the technical scope of the present invention as defined in the claims. Besides the following embodiments, a variety of other changes can be made without departing from the scope and spirit of the invention as defined in the claims.

The male housing is formed with the receiving portion in the foregoing embodiment. However, according to the invention, the receiving portion may be dispensed with if there is no likelihood that the lever is interfered with by other members in the standby position.

In the foregoing embodiment, the cam pin of the female housing and that of the moving plate are engaged with the one cam groove while being united. However, according to the invention, each arm may be provided with two cam grooves, so that the cam pin of the female housing and that of the moving plate can be separately engaged with the respective cam grooves.

Although the bracket is assembled with the male housing after the shipment of the male housing to the assembling site in the foregoing embodiment, it may be already assembled with the male housing before shipment.

Even though the invention was described with reference to an at least partially assembled lever type connector, the invention is meant to include also a lever type connector kit, i.e. a lever type connector according to the claims in its disassembled state.

Even though the invention was described with reference to cam grooves being provided on the lever and cam pins being provided on the female housing and moving plate, the invention is meant also to include embodiments in which the cam grooves are provided on the female housing and/or moving plate and the cam pins are provided on the lever.

What is claimed is:

1. A lever type connector, comprising:

a male housing having a receptacle, a female housing at least partially fittable into the receptacle and having at least one cam pin, a moving plate movable along a fitting direction in the receptacle and having at least one cam pin, and a lever having at least one cam groove engageable with the housing cam pins and rotatably supported on the male housing, the female housing and the moving plate being drawn in the fitting direction into the receptacle by rotating the lever in a connection direction from a connection start position to a connection end position with the cam pins and the cam groove engaged with each other, the lever being permitted to rotate in a direction opposite to the connection direction from the connection start position to a standby position opposite from the connection end position, and the cam groove being provided with a play area which is substantially not in engagement with the corresponding cam pin of the moving plate during rotation of the lever in a direction opposite to the connection direction from the connection start position toward the standby position.

2. The lever type connector according to claim 1, wherein the moving plate comprises a guide wall portion for guiding the movement of the moving plate inside the receptacle of the male housing.

3. The lever type connector according to claim 1, wherein the at least one cam pin of the female housing comprises a pair of cam pins, the at least one cam pin of the moving plate comprising a pair of cam pins, and the lever having a pair of cam grooves.

4. The lever type connector according to claim 1, wherein the male housing is formed with a receiving portion for receiving the lever when the lever is rotated to the standby position.

5. The lever type connector according to claim 4, wherein the receiving portion projects from the male housing such that the lever cannot be reached externally in a direction opposite to the fitting direction.

6. The lever type connector according to claim 1, wherein the cam pin of the female housing and the cam pin of the moving plate are unitable and the united cam pins are engaged with the corresponding cam groove.

7. The lever type connector according to claim 6, wherein the cam groove comprises a receiving inlet for receiving the corresponding cam pin upon mating the female housing with the male housing.

8. The lever type connector according to claim 1, wherein the male housing and the female housing are provided with locking means for releasably locking the lever in the connection start position, the connection end position and the standby position.

9. The lever type connector according to claim 8, wherein the cam pins of the moving plate are substantially held by inner surfaces of the play area along the fitting direction when the lever is positioned in the standby position.

10. The lever type connector according to claim 1, wherein the male housing is fittable into a bracket with the lever being positioned in a substantially upright position between the start position and the end position.

11. The lever type connector according to claim 10, wherein the lever comes into contact with the bracket in a direction opposite to the connection direction when the lever is positioned in the connection start position.

* * * * *